United States Patent [19]

Shidara

[11] Patent Number: 4,929,975

[45] Date of Patent: May 29, 1990

[54] AUTOMATIC FILM PROCESSOR

[75] Inventor: Shinichi Shidara, Kanagawa, Japan

[73] Assignee: Fuji Photo Film Co., Ltd., Kanagawa, Japan

[21] Appl. No.: 243,349

[22] Filed: Sep. 12, 1988

[30] Foreign Application Priority Data

Sep. 11, 1987 [JP] Japan ..... 62-226669
Sep. 11, 1987 [JP] Japan ..... 62-226670
Sep. 11, 1987 [JP] Japan ..... 62-226671
Sep. 11, 1987 [JP] Japan ..... 62-226672

[51] Int. Cl.[5] ..... G03D 3/04; G03D 3/08

[52] U.S. Cl. ..... 354/317; 354/322; 354/324; 354/328; 34/1; 34/155

[58] Field of Search ..... 354/317, 319, 320, 321, 354/322, 324, 328; 34/1, 155

[56] References Cited

U.S. PATENT DOCUMENTS 2,861,508 11/1958 Baumbach et al. ..... 354/325
2,945,760 7/1960 Ostergaard ..... 354/328
3,774,521 11/1973 Beck ..... 354/324
4,515,456 5/1985 Ferrante ..... 354/320
4,652,106 3/1987 Jurgensen et al. ..... 354/328

FOREIGN PATENT DOCUMENTS 2075372 11/1961 United Kingdom ..... 354/328

*Primary Examiner*—A. A. Mathews
*Attorney, Agent, or Firm*—Sughrue, Mion, Zinn, Macpeak & Seas

[57] ABSTRACT

An automatic film processor for passing an exposed film successively through a series of treating liquid vessels respectively containing developing liquid, fixing liquid and rinsing water is provided. The film processor comprises pump means for forming a constant regular flow to raise a portion of the liquid surface of at least one treating liquid vessel, and flow guide means for guiding the constant regular flow onto the liquid surface, whereby the underside of the exposed film contacts the surface of the raised portion of the liquid. In a modified embodiment, a vibrator for generating an ultrasonic wave is associated with at least one treating liquid vessel for applying ultrasonic vibration to the film so as to accelerate the treating speed.

14 Claims, 7 Drawing Sheets

AUTOMATIC FILM PROCESSOR

BACKGROUND OF THE INVENTION

1. Field of the Invention

The present invention relates to an automatic film processor for passing an exposed film successively through developing, fixing, rinsing and drying stations to effect automatic development of the film.

2. Prior Art Statement

The known automatic film processors for the automatic development of an exposed film include the roller conveyor type, loop type and horizontal conveying type.

In the roller conveyor type processor, the film is passed through the treating liquids (such as developing liquid, fixing liquid and rinsing water) by a number of rollers. This type of processor has disadvantages in that its construction is complicated and troublesome maintenance is required. In the loop type processor, the film is conveyed by rollers disposed above and below each of the treating liquid vessels. The disadvantages of this type of processor are similar to those of the roller conveyor type processor in that construction is complicated and maintenance is troublesome. In the horizontal conveying type processor, the film is conveyed linearly in the horizontal direction and treating liquids are vigorously sprayed onto the conveyed film. However, the treating liquids, and particularly the developer liquid, are deteriorated due to oxidation.

The known automatic developers have further disadvantages in that they are large in size for the following reasons. In the roller conveyor type processor, the film is conveyed through each of the treating liquid vessels by a number of rollers disposed deep in the vessel which extends vertically for a long distance. In the loop conveying processor, the film is suspended between the rollers disposed at the upper and lower portions in the treating liquid vessels which are large in size. In the horizontal conveying type processor, the film is conveyed horizontally and each treating liquid is vigorously sprayed onto the film. However, in order to complete the treatment at a high speed, the film must contact each treating liquid by a long pass in the horizontal direction, which results in the increased size of the device. This virtually limits the treating speed of the device. The horizontal conveying type processor has another disadvantage in that it requires a pump for ejecting the treating liquid which complicates the structure of the film processor.

In the automatic film processor in which an exposed film is processed continuously, successive processing operations including development, fixing and rinsing must be conducted in order and then the film should be dried sufficiently. In the drying step, water must be thoroughly removed, for example, by the use of a sponge. If water drops are left on the film, blurs are formed on the surface of the dried film. Drying at an excessively high temperature results in deterioration in granularity due to softening of the gelatine membrane, which might cause intense curling. On the contrary, the treating speed of the entire system is decreased if the drying speed is lowered.

OBJECTS AND SUMMARY OF THE INVENTION

Accordingly, a first object of this invention is to provide an automatic film processor which is simple in construction and easily maintainable and in which deterioration of treating liquids, particularly degradation of developer liquid due to oxidation, can be suppressed.

A second object of this invention is to provide an automatic film processor which is small in size and adapted for high speed processing.

A third object of this invention is to provide an automatic film processor which is simple in construction without requiring a pump, and which is small in size and adapted for high speed processing.

A fourth object of this invention is to provide an automatic film processor which is free from the appearance of blurs due to uneven drying, deterioration in granurality or occurrence of curling, and which is adapted for high speed drying to realize high speed processing.

The first object of this invention is accomplished by the provision of an automatic film processor for passing an exposed film successively through a series of treating liquid vessels respectively containing developing liquid, fixing liquid and rinsing water, which comprises:

a pump means for forming a constant regular flow to rise a portion of the liquid surface of at least one treating liquid vessel; and flow guide means for guiding the constant regular flow onto the liquid surface;

whereby the underside of the exposed film is allowed to contact with the surface of the raised portion of the liquid.

Namely, according to the first aspect of this invention, the surface of the treating liquid is raised partially and the exposed film is allowed to contact the raised portion of the treating liquid while preventing the treating liquid from mixing vigorously with air to prevent oxidation of the treating liquid.

The second object of this invention is achieved by the provision of an automatic film processor for passing an exposed film successively through a series of treating liquid vessels respectively containing developing liquid, fixing liquid and rinsing water, which comprises:

an ultrasonic wave generating means associated with at least one of the treating liquid vessels for applying ultrasonic vibration to the exposed film so as to accelerate the treating speed.

In other words, according to the second aspect of this invention, the treating speed is increased by the utilization of ultrasonic wave.

The third object of this invention is achieved by the provision of an automatic film processor for passing an exposed film successively through a series of treating liquid vessels containing respectively developing liquid, fixing liquid and rinsing water, which comprises:

an ultrasonic wave generating means associated with at least one of the treating liquid vessels for applying ultrasonic vibration to the treating liquid near the liquid surface of said treating liquid so as to form a rised portion on the liquid surface and for applying ultrasonic vibration to the downside of said exposed film to accelerate the treating speed.

Ejecting flow is formed on the surface of the treating liquid by the utilization of the ultrasonic wave. At the same time, vibration by the ultrasonic wave is applied to the film in contact with the ejecting flow, whereby the treating speed is accelerated.

The fourth object of this invention is achieved by the provision of an automatic film processor for passing an exposed film successively through a series of treating liquid vessels respectively containing developing liquid, fixing liquid and rinsing water, and then for passing the treated film to a drying station, which comprises:

an ultrasonic wave generating means associated with the drying station for applying ultrasonic vibration to the film so as to accelerate drying of the film.

By applying an ultrasonic wave to the film, water adhering to the surface of the film is evenly dispersed to wet the surface uniformly so as to prevent the formation of blurs upon drying and to promote vaporization of water in order to decrease the time required for drying.

The second and fourth objects of this invention may also be achieved by the provision of an automatic film processor for passing an exposed film successively through a series of treating liquid vessels respectively containing developing liquid, fixing liquid and rinsing water, and then for passing the treated film to a drying station, which comprises:

an ultrasonic wave generating means associated with at least one of the treating liquid vessels for applying ultrasonic vibration to the exposed film so as to accerelate the treating speed; and further ultrasonic wave generating means associated with the drying station for applying ultrasonic vibration to the film so as to accerelate drying of the film.

The processing speed of the entire film processor is further accelerated by the last mentioned aspect of this invention.

DESCRIPTION OF PREFERRED EMBODIMENTS

Figure 1:
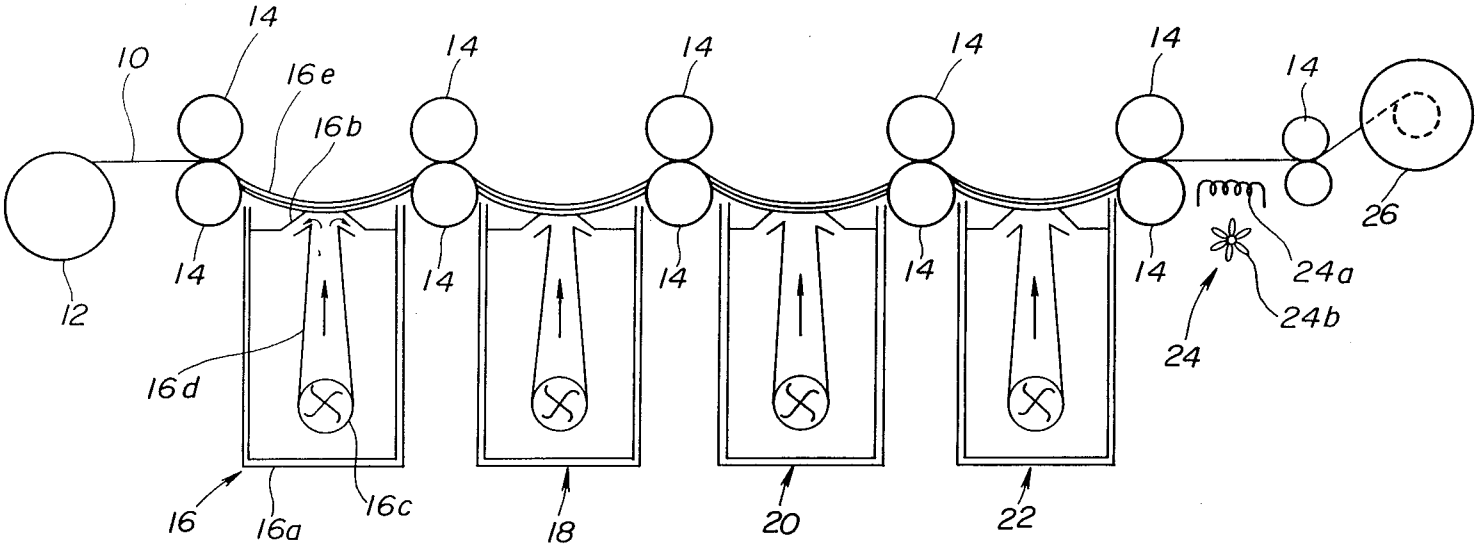
FIG. 1 is a schematic illustration showing an embodiment according to the first aspect of this invention.

The present invention will now be described with reference to presently preferred embodiments of this invention. Initially an embodiment according to the first aspect of this invention will be described by referring to FIG. 1. An exposed roll film 10 is fed from a supply reel 12. The film 10 is clamped by feed roller pairs 14, 14 to be passed through a developing station 16, fixing station 18, a first rinsing station 20, a second rinsing station 22 and a drying station 24 in this order, and then taken up by a take-up reel 26. Each feed roller pair 14 is disposed between one processing station and the next processing station to convey the film 10 at a constant speed.

The developing station 16 comprises a developer liquid vessel **16*a* containing a developer liquid, a pump 16*c* for forming a raised regular flow 16*b* and a flow guide member 16*d*. The flow guide member 16*d* guides the developer liquid discharged from the pump 16*c* upwardly in the vertical direction so that the developer liquid wells out on the surface of the liquid. The well-out port of the flow guide member 16*d* opens transverse to the travelling direction of the film 10 and extends to cover the entire width of the film 10. The top edges of the well-out port are bent to form downward rims so that the developer liquid discharged from the flow guide member 16*d*** wells out of the port to form a regular flow. In other words, a portion of the liquid surface is raised.

An arcuated guide member **16*e* projecting downwardly extends between the fore and aft roller pairs 14. The side edges of the film 10 are guided by the arcuated guide member 16*e* to be conveyed along the arcuated path so that the surface of the exposed film 10 contacts the raised portion of the regular flow 16*b*** to be developed.

The construction of the fixing station 18, the first rinsing station 20 and the second rinsing station 22 is similar to that of the developing station 16 except in that a fixing liquid and rinsing liquids, respectively, are used in place of the developer liquid. Accordingly. the construction of stations 18, 20 and 22 are not described for simplicity.

The drying station 24 comprises a heater **24*a* and a fan 24*b*. The film 10 is dried by hot air heated by the heater 24*a* and blown by the fan 24*b***.

According to this embodiment, the film 10 is successively passed through the stations 16 to 24 at a constant speed and processed at respective stations. For instance, the film 10 moves through the developing station 16 at which it contacts the raised portion of a regular flow **16*b* of the developer liquid, the regular flow being formed by the pump 16*c* and the flow guide member 16*d*, to be subjected to development. Fixing and rinsing treatments are conducted similarly in the fixing and rinsing stations 18 to 22, and then the film 10 is dried and taken up by the take-up reel 26**.

Although the fixing and rinsing stations 18 to 22 have the same construction as the developing station 16 in the embodiment described above, the constructions of the fixing and rinsing stations 18 to 22 may be differenciated within the scope of this invention.

Different embodiments of the developing station, according to this invention, are shown in FIGS. 2 to 6.

Figure 2:
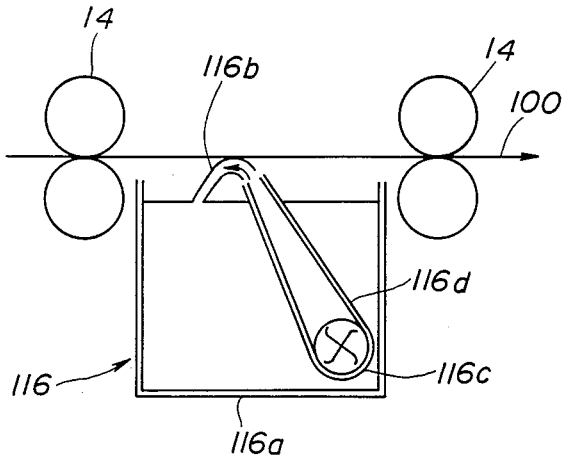
FIGS. 2 to 6 are schematic illustrations respectively showing embodiments of the developing station according to this invention.

The developing station 116 shown in FIG. 2 comprises a pump **116*c* disposed in the developer liquid vessel 116*a*. The developer liquid contained in the developer liquid vessel 116*a* is pumped by the pump 116*c* and guided by the flow guide member 116*d* to be ejected obliquely to form a fall-like flow (raised regular flow 116*b*) from the liquid surface. The underside of the film 10, conveyed along a substantially horizontal pass, contacts the raised regular flow 116*b*** of the developer liquid to effect development.

Figure 3:
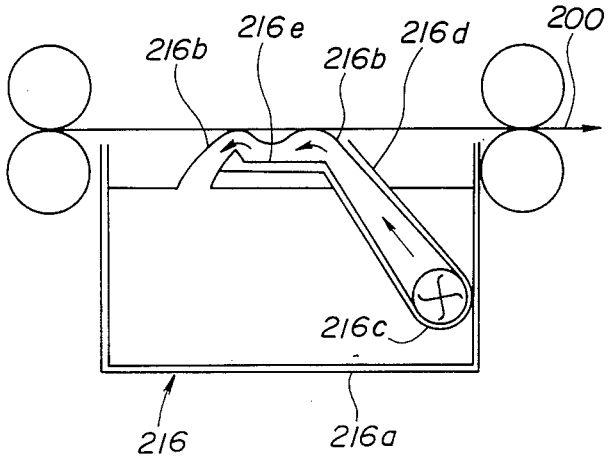

The developing station 216 shown in FIG. 3 comprises a pump **216*c* disposed in a developer liquid vessel 216*a* containing a developer liquid which is guided by a flow guide member 216*d* to be ejected obliquely from the liquid surface. An integral or separate flow guide plate 216*e* extends horizontally from the liquid eject port of the flow guide member 216*d*. The downstream end of the flow guide plate 216*e* projects upwardly so that the developer liquid is raised at the eject port and at the downstream end of the flow guide plate 216*e*. As a result, a regular flow having two raised portions 216*b*, 216*b* is formed. The underside of the film 200 conveyed along a substantially horizontal pass contacts the developer liquid at these two raised portions 216*b* and 216*b***.

Figure 4:
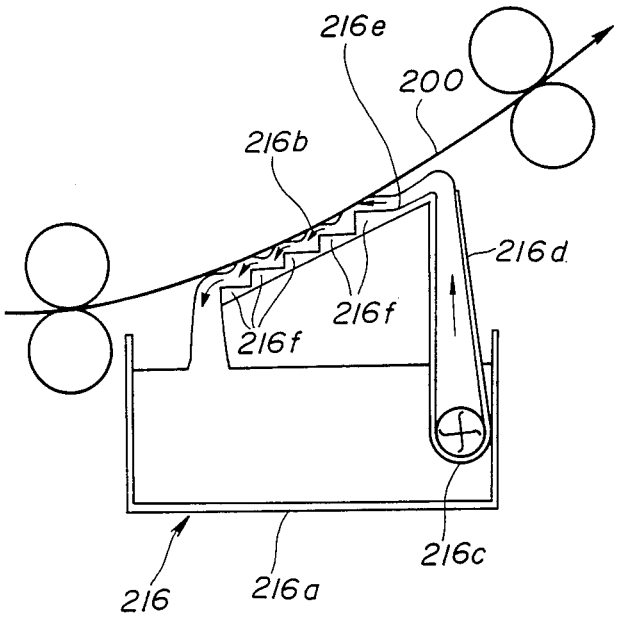

A further modified embodiment is shown in FIG. 4, wherein the flow guide plate **216*e* has plural steps 216*f*** so that the developer liquid forms a regular flow having plural raised portions 216*b*.

Figure 5:
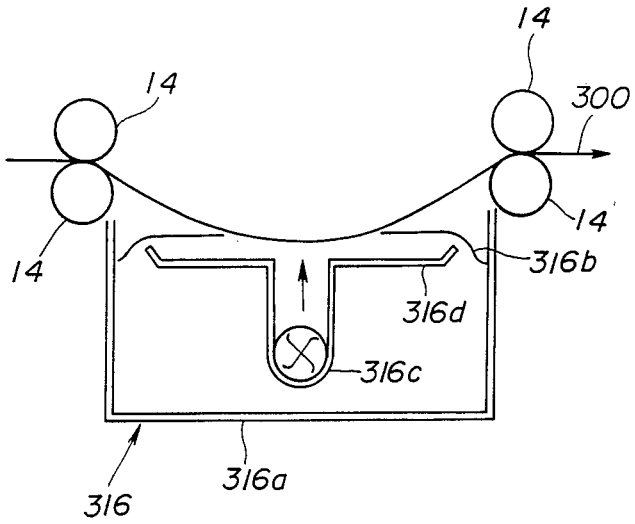

A flow guide member 316*d* of the developing station 316 shown in FIG. 5 is a circular disk having an opening for passing an upward flow of the treating liquid at substantially the center thereof, the peripheral edge of the circular disk being bent upwardly. The developer liquid is fed from a pump 316*c* through a center opening and flows over the upside of the flow guide plate 316*d* so that a regular well-out flow 316*b* is formed at the peripheral edge. A film 300 is conveyed along a horizontal or arcuated pass while contacting the well-out flow 316*b*.

Figure 6:
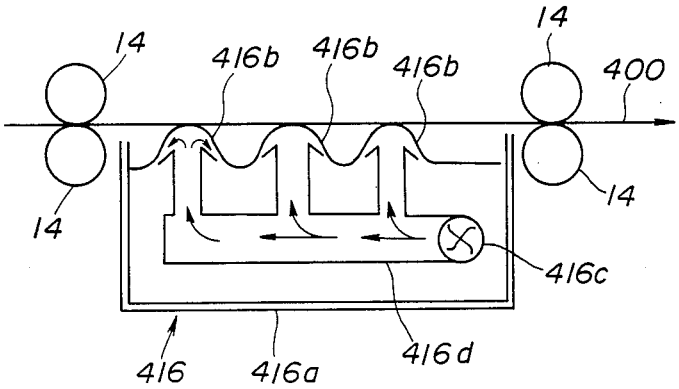

The developing station 416 shown in FIG. 6 comprises a flow guide member 416*d* which guides the developer liquid along plural vertical flow lines. The developer liquid is pumped by a pump 416*c* and flows through plural flow lines to form plural raised portions 416*b* on the liquid surface. A film 400 conveyed along a substantially horizontal pass contacts the developer liquid at these plural raised portions 416*b*.

Although the developing station has been described with reference to FIGS. 2 to 6, any of the embodiments shown in FIGS. 2 to 6 may be incorporated in the fixing and rinsing stations. Within the scope of this invention, the same or different embodiments shown in FIGS. 2 to 6 may be incorporated arbitrarily in the developing, fixing and rinsing stations.

According to the present invention, a portion of the treating liquid is raised to form a regular flow having a rised portion, and the film is moved while contacting with the rised portion of the regular flow. The number of the feed roller pairs can be decreased to simplify the construction to realize easy maintenance of the system as compared to the conventional roller conveying system or loop conveying system. Since the developer liquid is flown to form a regular flow rather than being sprayed onto the film, vigourous mixing of the developer liquid with air is prevented to suppress deterioration thereof due to oxidation.

The second aspect of this invention will now be described with reference to FIG. 7. An exposed film 10 is supplied from a supply reel 12 and moved by roller pairs 14 through a developing station 16, a fixing station 18, a first rinsing station 20, a second rinsing station 22 and a drying station 24 to be taken up by a take-up reel 26. Drums 16*f* to 22*f* are disposed in the treating liquid vessels 16*a* to 22*a* of respective stations 16 to 22, and the film 10 is immersed in the treating liquids in the vessels 16*a* to 22*a* while moving along the circumferences of the drums 16*f* to 22*f*. A developer liquid is contained in the treating liquid vessel 16*a*, and a fixing liquid is contained in the treating liquid vessel 18*a*. The treating liquid vessels 20*a* and 22*a* contain rinsing liquids.

Ultrasonic vibrators 16*g* to 22*g*, which act as the ultrasonic wave generating means, are mounted on the bottoms of the treating liquid vessels 16*a* to 22*a* to generate ultrasonic waves. Each of the ultrasonic vibrators 16*g* to 22*g* is actuated by an actuating circuit (not shown). Preferably, the ultrasonic wave generated from each of the ultrasonic vibrators 16*g* to 22*g* is focused at the vicinity of the surface of the film 10 which moves along the circumferences of the drums 16*f* to 22*f*. Otherwise, the portion or whole mass of the treating liquid may be vibrated by the ultrasonic vibrator. Anyway, the ultrasonic wave is applied to the film 10 to accelerate the treating speed. In the developing station 16, penetration of the developer liquid into the photosensitive emulsion layer of the film 10 is promoted by the action of the ultrasonic wave so as to accelerate the reaction between the latent image in the silver halide crystallites and the developing agent to promote reduction of silver ions (blackening) in the silver halide crystallites. In the fixing station 18, the speed of dissolving silver halide is accelerated by the application of the ultrasonic wave to promote the removal rate in the fixing step. In the rinsing stations 20, 22, removal of the fixing liquid or silver thiosulfate is accelerated to increase the rinsing rate.

The drying station 24 comprises an electric heater 24*a* serving as heating means, a fan 24*b* serving as air blower means, and an ultrasonic vibrator 24*g* serving as ultrasonic wave generating means. The ultrasonic vibrator 24*g* opposes the underside, i.e. the side to be subjected to development, of the film 10, and the ultrasonic wave is applied to the underside of the film 10. Air blown from the fan 24*b* is heated by the heater 24*a* to form hot stream which impinges the film 10.

Rinsing water adhering on the film 10 is dispersed rapidly, under the action of the ultrasonic wave generated from the ultrasonic vibrator 24*g* and applied to the film 10, to form a thin membrane. The ultrasonic wave also acts to scatter water mists from the film. The drying speed is considerably increased by the combined action of ultrasonic wave and hot air stream heated by the heater 24*b*. The film 10 passing out of the drying station 24 is taken up by a take-up reel 26.

Reference numeral 28 designates an optical sensor for detecting the fore end of the film 10, and ultrasonic vibrators 16*g* to 22*g* and 24*g* are actuated as the fore end of the film 10 is sensed by the sensor 28.

In the illusrated embodiment, ultrasonic vibrators are incorporated in all of the developing, fixing, rinsing and drying stations 16 to 24, whereby treatments at every station are accelerated so that the pass, i.e. the distance of the film 10 contacting each treating liquid, of each treating station time can be decreased. The construction of the entire system is simplified, the size of the system is decreased, and the treating speed of the system is increased.

Each of the ultrasonic vibrators 16*g* to 24*g* may be made of a quartz vibrator, or a vibrator utilizing the piezoelectric phenomenon of lead zirconate titanate (PZT) which is one of ceramics, polyvinylidene fluoride (PVDF) which is one of plastics or a composite material of ceramics (PECM). However, it is to be noted here that means for generating ultrasonic wave is not limited only to the vibrators described above for example only.

Figure 8:
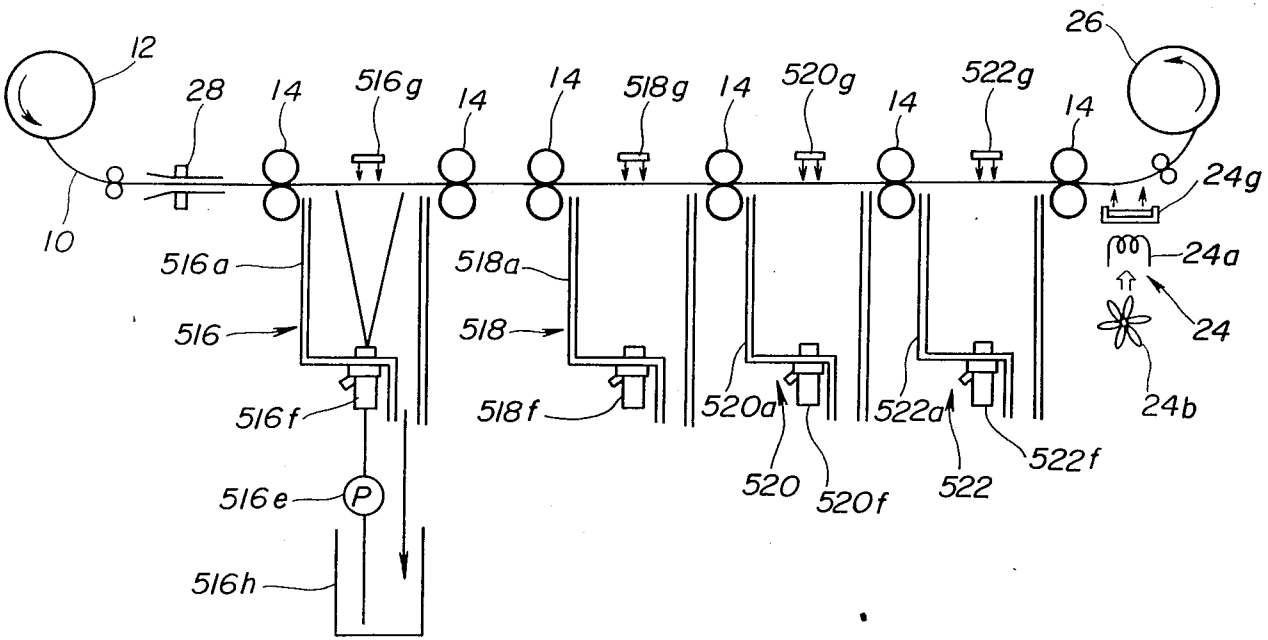
FIG. 8 is a schematic illustration showing another embodiment according to the second aspect of this invention.

Another embodiment is shown in FIG. 8, wherein respective treating stations 516 to 522 comprise spraying nozzles 516*f* to 522*f* disposed at the bottoms of respective treating liquid vessels 516*a* to 522*a* to spray respective treating liquids onto the underside of the film 10. Ultrasonic vibrators 516*g* to 522*g* are disposed above respective treating liquid vessels 516*a* to 522*a* so that ultrasonic waves are applied to the upside of the film 10. At the developing station 516, the developer liquid is collected in a tank 516*h* and recirculated by a pump 516*e* to the spraying nozzle 516*f*. Similar collection tanks and recirculating pumps are provided in respective stations 518 to 522. Different from the embodiment shown in FIG. 7 in which the ultrasonic wave is transmitted to the film 10 through the treating liquid, the ultrasonic wave is transmitted through air in this embodiment. The other members denoted by the same reference numerals as used in FIG. 7 have the same constructions and exhibit the same functions, and descriptions thereof will not be repeated.

Figure 9:
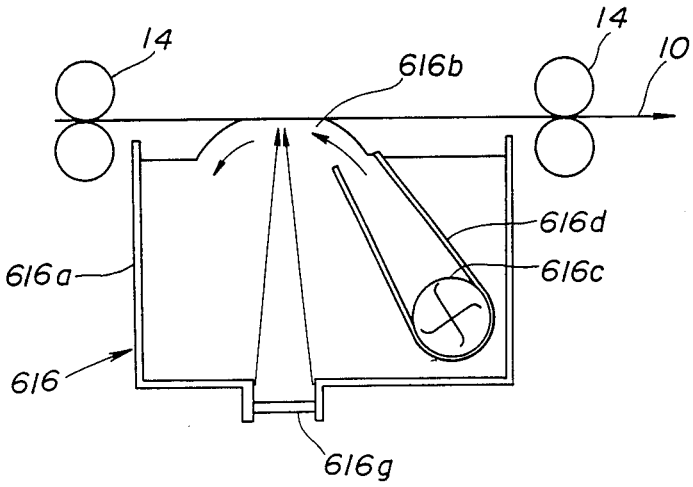
FIG. 9 is a schematic illustration showing a further embodiment according to the second aspect of this invention.

A developing station 616 of a further embodiment is shown in FIG. 9. In this embodiment, the developer liquid in the treating liquid vessel 616*a* is pumped by a pump 616*c* and guided obliquely by a flow guide member 616*d* to form a regular flow 616*b* which is raised upwardly. An ultrasonic vibrator 616*g* is mounted on the bottom of the treating liquid vessel 616*a* to serve as the means for generating the ultrasonic wave so that the ultrasonic wave is focused on the raised portion of the regular flow 616*b*. As a result, ultrasonic vibration is applied to the film 10 contacting the raised regular flow 616*b* to accelerate the treating speed. The object of this invention may also been achieved by transmitting the ultrasonic wave generated from the ultrasonic vibrator 616*g* through the developer liquid rather than focusing it at the vicinity of the film 10. Ultrasonic vibration may be applied to the upside of the film 10 as shown in FIG. 8.

Figure 7:
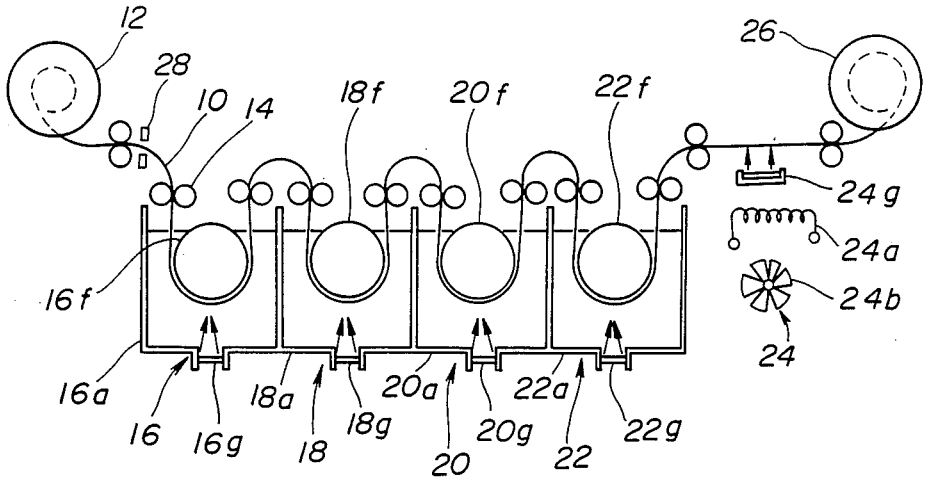
FIG. 7 is a schematic illustration showing an embodiment according to the second aspect of this invention.

In the embodiments shown in FIGS. 7 and 8, all of the treating stations 16 to 22 and 516 to 522 are provided with ultrasonic vibrators. However, the present invention may encompass an embodiment in which an ultrasonic vibrator is incorporated only in one of these treating stations.

The present invention may be applied not only to a so-called two-bath processing system wherein the development and fixing are effected by a separate developing station and fixing station, but also to a so-called mono-bath processing system wherein develoment and fixing are effected in a single combined bath.

When an ultrasonic vibrator is provided at the drying station to prevent uneven drying and to accelerate the drying speed, the object of the invention may be achieved by constructing the treating stations other than the drying station according to the conventional technology.

As has been described hereinabove, ultrasonic vibration is applied to the film during at least one processing steps so that the treating speed is considerably accelerated to promote processing. High speed processing can be realized and the size of the processing system can be decreased.

When the rinsed film is dried during the application of the ultrasonic wave, waterdrops adhering on the film are dispersed by the action of ultrasonic vibration to form a thin membrane and are concurrently scattered to the atmosphere. Formation of blurs due to uneven drying is prevented and the film may be dried rapidly at a relatively low temperature. Deterioration in granularity and the occurrence of curling are prevented, also accordingly. Rapid drying enables high speed operation of the system and also the realization of a compact system.

Figure 10:
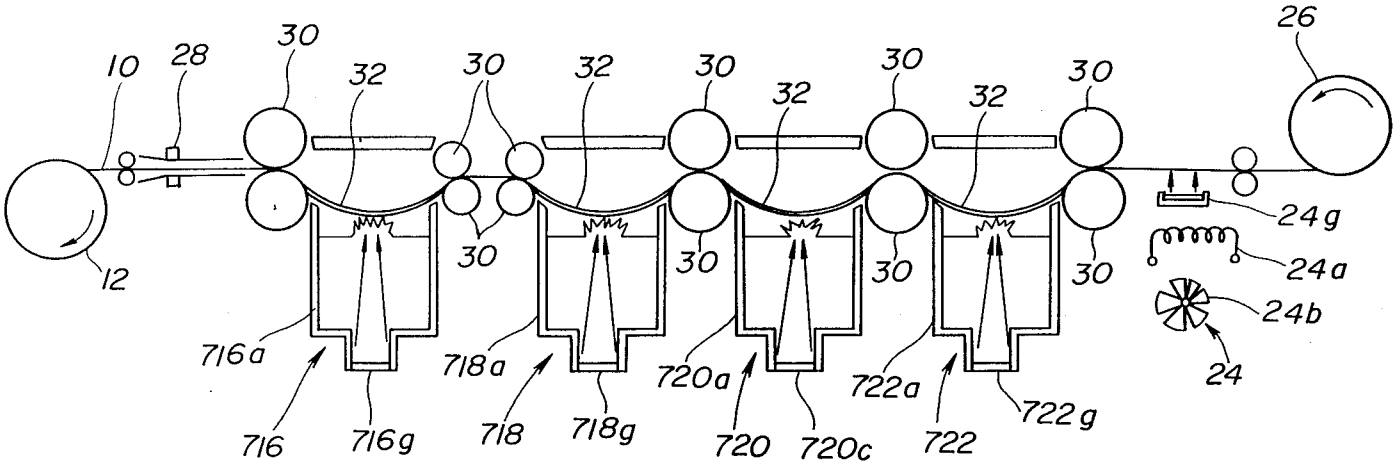
FIG. 10 is a schematic illustration showing an embodiment according to the third aspect of this invention.

The third aspect of this invention will now be described with reference to FIG. 10. An exposed film 10 is supplied from a supply reel 12, passed through a developing station 716, a fixing station 718, a first rinsing station 720, a second rinsing station 722 and a drying station 724, and taken up by a take-up reel 26. A developer liquid is contained in a developer liquid vessel 716*a* of the developing station 716, and a fixing liquid is contained in a fixing liquid vessel 718*a* of the fixing station 718. Rinsing water vessels 720*a* and 722*a* of the rinsing stations 720 and 722 contain rinsing water. A guide member 32 for guiding the film 10 close to the surface of each treating liquid contained in the treating liquid vessels 716*a* to 722*a* is disposed between adjacent guide roller pairs 30. The film 10 travels above the opening of each of the treating liquid vessels 716*a* to 722*a* while being guided by each guide member 32 along an arcuated path coming close to the liquid surface.

Ultrasonic vibrators 716*g* to 722*g* are mounted on the bottoms of respective treating liquid vessels 716*a* to 722*a* to serve as ultrasonic wave generating means. Each of the ultrasonic vibrators 716*g* to 722*g* are actuated by an actuating circuit (not shown) and focused at the vicinity of the center of the liquid surface. As a result, the treating liquid contained in each of the treating liquid vessels 716*a* to 722*a* forms a spout on the liquid surface near the focal point of the ultrasonic wave. The treating liquid contained in each of the treating liquid vessels 716*a* to 722*a* spouts upwardly from the liquid surface and scatters vigorously from the spouting liquid to form mists. As the film 10 travels at the vicinity of spouting liquid, the spouting mists contact with the downside of the film 10 so that develoment, fixing and rinsing are effected over the vessels 716*a* to 722*a*. The ultrasonic vibrations are transmitted to the film 10 per se so that treatments by respective stations are promoted to accelerate the treating speeds.

The flow rate of the spouting flow rising from the liquid surface or the quantity of mists emitted therefrom may be controlled by changing the electric voltage for actuating each of the ultrasonic vibrators 716*a* to 722*g*. In this manner, the treating speed at each treating station 716 to 722 may be controlled.

In the illustrated embodiment, all of the developing, fixing and rinsing stations 716 to 722 are provided with ultrasonic vibrators, so that treatments at every steps are promoted to decrease the passes in respective treating stations. Considerable simplification, reduction in size and high speed operation of the entire system may be realized at the same time. However, the present invention may include a system in which the ultrasonic vibrator is provided in any one or more of the treating stations.

Although a single ultrasonic vibrator 716*g* to 722*g* is used in each of the treating stations 716 to 722 in the illustrated embodiment, plural ultrasonic vibrators may be used in each treating station. When plural ultrasonic vibrators are used, one of them is used to generate an ultrasonic vibration suited for spouting the liquid over the surface of the treating liquid and the other is used to generate an ultrasonic vibration optimal for promoting processing of the film.

Although it is preferred to transmit the ultrasonic vibration through the treating liquid to increase the efficiency of the action of the vibrator, the present invention includes those wherein ultrasonic vibration is applied through air above the treating liquid.

As has been described hereinabove, since a spouting flow is formed on the liquid surface by the application of the ultrasonic wave and the film is moved so that the downside of the film contacts the spouting flow according to this invention, the number of required conveyor rollers can be decreased and the pump means can be eliminated to simplify the construction of the system. The depth of each treating liquid vessel can be decreased and each treatment can be promoted by the utilization of the ultrasonic vibration to shorten the path of each treatment. Size reduction and high speed operation of the system can be realized, accordingly.

What is claimed is:

1. An automatic film processor for passing an exposed film successively through a series of treating liquid vessels respectively containing developing liquid, fixing liquid and rinsing water, which comprises:

pump means for forming a constant regular flow to raise a portion of a liquid surface of at least one of a plurality of treating liquid vessels; and flow guide means for guiding said constant regular flow onto said liquid surface;

whereby the underside of an exposed film is allowed to contact the surface of said raised portion of said liquid.

2. The automatic film processor according to claim 1, wherein said flow guide means delivers the treating liquid in the upward direction.

3. An automatic film processor for passing an exposed film successively through a series of treating liquid vessels respectively containing developing liquid, fixing liquid and rinsing water, which comprises:

pump means for forming a constant regular flow to raise a portion of a liquid surface of at least one of a plurality of treating liquid vessels; and flow guide means for guiding said constant regular flow onto said liquid surface;

whereby the underside of an exposed film is allowed to contact the surface of said raised portion of said liquid, and wherein said flow guide means ejects the treating liquid obliquely to the vertical direction so as to form a fall-like flow which flows along an arcuated overhang flow path.

4. An automatic film processor for passing an exposed film successively through a series of treating liquid vessels respectively containing developing liquid, fixing liquid and rinsing water, which comprises:

pump means for forming a constant regular flow to raise a portion of a liquid surface of at least one of a plurality of treating liquid vessels; and flow guide means for guiding said constant regular flow onto said liquid surface;

whereby the underside of an exposed film is allowed to contact the surface of said raised portion of said liquid, and wherein said flow guide means ejects the treating liquid obliquely to the vertical direction, and wherein said flow guide means includes a flow guide plate extending substantially horizontally and having a downstream edge rising upwardly, whereby said treating liquid flows through a flow path having two raised portions.

5. An automatic film processor for passing an exposed film successively through a series of treating liquid vessels respectively containing developing liquid, fixing liquid and rinsing water, which comprises:

pump means for forming a constant regular flow to raise a portion of a liquid surface of at least one of a plurality of treating liquid vessels; and flow guide means for guiding said constant regular flow onto said liquid surface;

whereby the underside of an exposed film is allowed to contact the surface of said raised portion of said liquid, and wherein said flow guide means ejects the treating liquid upwardly, and wherein said flow guide means includes a flow guide plate having plural steps, whereby said treating liquid flows through a flow path having plural raised portions.

6. An automatic film processor for passing an exposed film successively through a series of treating liquid vessels respectively containing developing liquid, fixing liquid and rinsing water, which comprises:

pump means for forming a constant regular flow to raise a portion of a liquid surface of at least one of a plurality of treating liquid vessels; and flow guide means for guiding said constant regular flow onto said liquid surface;

whereby the underside of an exposed film is allowed to contact the surface of said raised portion of said liquid, and wherein said flow guide means comprises a flow guide plate of generally circular disk shape having an opening for passing an upward flow of said treating liquid at the substantial center thereof, the peripheral edge of said circular disk being bent upwardly, whereby said treating liquid flows from the center of said flow guide plate to the peripheral edge of said flow guide plate while being raised at the peripheral edge.

7. The automatic film processor according to claim 1, wherein said flow guide means comprises a flow guide plate having plural openings for passing plural upward flows of said treating liquid so that plural raised portions are formed on the liquid surface.

8. An automatic film processor for passing an exposed film successively through a series of treating liquid vessels respectively containing developing liquid, fixing liquid and rinsing water, which comprises:

ultrasonic wave generating means associated with at least one of a plurality of treating liquid vessels for applying ultrasonic vibration to said exposed film so as to accelerate the treating speed, wherein said treating liquid vessel is provided with pump means for forming a constant regular flow to raise a portion of the liquid surface of said treating liquid vessel, and flow guide means for guiding said constant regular flow onto the liquid surface, and wherein said ultrasonic wave generating means is disposed internally of said treating liquid vessel for applying ultrasonic vibration to said exposed film so that the underside of said exposed film is allowed to contact the surface of the raised portion of the liquid so as to accelerate the treating speed.

9. An automatic film processor for passing an exposed film successively through a series of treating liquid vessels respectively containing developing liquid, fixing liquid and rinsing water, which comprises:

ultrasonic wave generating means associated with at least one of said treating liquid vessels for applying ultrasonic vibration to said treating liquid at the neighbourhood of the liquid surface of the treating liquid so as to form a raised portion on said liquid surface and for applying ultrasonic vibration to the downside of said exposed film to accelerate the treating speed.

10. An automatic film processor for passing an exposed film successively through a series of treating liquid vessels respectively containing developing liquid, fixing liquid and rinsing water, and then for passing the treated film to a drying station, which comprises:

ultrasonic wave generating means associated with said drying station for applying ultrasonic vibration to the film so as to accelerate drying of the film.

11. The automatic film processor according to claim 10, wherein said drying station further comprises heating means for heating said film.

12. The automatic film processor according to claim 10, wherein said drying station further comprises heating means for heating said film and air blower means for blowing air onto said film.

13. An automatic film processor for passing an exposed film successively through a series of treating liquid vessels respectively containing developing liquid, fixing liquid and rinsing water, and then for passing the treated film to a drying station, which comprises:

ultrasonic wave generating means associated to at least one of said treating liquid vessels for applying ultrasonic vibration to said exposed film so as to accerelate the treating speed; and further ultrasonic wave generating means associated with said drying station for applying ultrasonic vibration to the film so as to accelerate drying of the film.

14. The automatic film processor according to claim 13, wherein said ultrasonic wave generating means is disposed internally of said treating liquid vessel for applying ultrasonic vibration to said exposed film immersed in the treating liquid so as to accelerate the treating speed.

* * * * *